US007073599B2

(12) United States Patent
Smith

(10) Patent No.: US 7,073,599 B2
(45) Date of Patent: Jul. 11, 2006

(54) MONOBORE WELLBORE AND METHOD FOR COMPLETING SAME

(75) Inventor: Ray C. Smith, Beaumont (CA)

(73) Assignee: Halliburton Energy Services, Inc., Houston, TX (US)

( * ) Notice: Subject to any disclaimer, the term of this patent is extended or adjusted under 35 U.S.C. 154(b) by 195 days.

(21) Appl. No.: 10/759,257

(22) Filed: Jan. 16, 2004

(65) Prior Publication Data

US 2004/0168808 A1 Sep. 2, 2004

Related U.S. Application Data

(63) Continuation-in-part of application No. 10/103,381, filed on Mar. 21, 2002, now Pat. No. 6,749,026.

(51) Int. Cl.
*E21B 17/00* (2006.01)

(52) U.S. Cl. ..... 166/380; 166/384; 166/50; 166/52

(58) Field of Classification Search ..... 166/380, 166/207, 117.6, 117.5, 313, 245, 384, 50, 166/244.1, 52
See application file for complete search history.

(56) References Cited

U.S. PATENT DOCUMENTS

| | | | | |
|---|---|---|---|---|
| 5,458,209 | A | 10/1995 | Hayes et al. | |
| 5,564,503 | A | 10/1996 | Longbottom et al. | |
| 5,615,740 | A | 4/1997 | Comeau et al. | |
| 6,070,671 | A * | 6/2000 | Cumming et al. | 166/207 |
| 6,079,493 | A | 6/2000 | Longbottom et al. | |
| 6,089,320 | A | 7/2000 | LaGrange | |
| 6,092,593 | A | 7/2000 | Williamson et al. | |
| 6,135,208 | A | 10/2000 | Gano et al. | |
| 6,138,761 | A | 10/2000 | Freeman et al. | |
| 6,209,644 | B1 * | 4/2001 | Brunet | 166/117.6 |
| 6,241,021 | B1 | 6/2001 | Bowling | |
| 6,325,148 | B1 | 12/2001 | Trahan et al. | |
| 6,457,532 | B1 | 10/2002 | Simpson | |
| 6,557,640 | B1 * | 5/2003 | Cook et al. | 166/380 |
| 6,732,802 | B1 | 5/2004 | Smith | |
| 6,749,026 | B1 | 6/2004 | Smith et al. | |

(Continued)

FOREIGN PATENT DOCUMENTS

FR 2 692 316 A1 6/1992

(Continued)

OTHER PUBLICATIONS

Sperry-Sun Multilateral Services Profile; "LRS-SL Self-Locating Lateral Re-entry System"; 2000; 2 pages.

(Continued)

*Primary Examiner*—Jennifer H. Gay
*Assistant Examiner*—Matthew J. Smith
(74) *Attorney, Agent, or Firm*—Lawrence R. Youst

(57) ABSTRACT

A monobore wellbore (68) and method for completing the same are disclosed. The monobore wellbore (68) comprises a first casing (74) having an inner diameter (76) and a lap region (80). A second casing (90) is positioned within the wellbore (70) by passing through the first casing (74) such that an uphole end of the second casing (90) is positioned within the lap region (80) of the first casing (74). After downhole expansion, the second casing (90) has an inner diameter (114) that is substantially the same as the inner diameter (76) of the first casing. The uphole end of the second wellbore is coupled to the lap region (80) of the first casing (74) to create a mechanical connection and a hydraulic seal, thereby creating the monobore wellbore (68).

22 Claims, 13 Drawing Sheets

U.S. PATENT DOCUMENTS

| | | | | |
|---|---|---|---|---|
| 2003/0192717 | A1 | 10/2003 | Smith et al. | |
| 2004/0262014 | A1* | 12/2004 | Cook et al. | 166/380 |
| 2005/0173108 | A1* | 8/2005 | Cook | 166/207 |

FOREIGN PATENT DOCUMENTS

| | | | |
|---|---|---|---|
| GB | 2 345 308 | A | 7/2000 |
| GB | 2 386 626 | A | 9/2003 |
| WO | WO 00/37768 | | 6/2000 |
| WO | WO 00/37771 | | 6/2000 |

OTHER PUBLICATIONS

Sperry-Sun Multilateral Services Profile; "LRW-SL Self-Locating Lateral Re-entry Whipstock"; 2000; 2 pages.
Sperry-Sun Multilateral Services Profile; "LRS Lateral Re-entry System"; 2000; 2 pages.
Sperry-Sun Multilateral Services Profile; "WREAL Wireline Re-entry Alignment System"; 2000; 2 pages.
Sperry-Sun Multilateral Services Profile; "TEW Tubing Exit Whipstock"; 2000; 2 pages.
Sperry-Sun Multilateral Servies Profile; "LRW Lateral Re-entry Whipstock"; 2000; 2 pages.
Sperry-Sun Multilateral Servies Profile; "TPI Through-Tubing Pressure Isolation Sleeve"; 2000; 2 pages.
Sperry-Sun Multilateral Services Profile; "Vector Block"; 2000; 2 pages.
Sperry-Sun Multilateral Services Profile; "RDS Re-entry Drilling System"; 2000; 2 pages.
Sperry-Sun Multilateral Services Profile; "MERLIN Milled Exit Retrievable Multilateral System"; 2000; 2 pages.
Sperry-Sun Multilateral Services Profile; "4502/4503 Metal Mill-Through Systems"; 2000; 2 pages.
Sperry-Sun Multilateral Services Profile; "RMLS Retrievable Multilateral System"; 2000; 2 pages.
Sperry-Sun Multilateral Services Profile; "LTBS Lateral Tie-Back System"; 2000; 2 pages.
Sperry-Sun Multilateral Services Profile; "PACE-6 Pressure-Actuated Casing Exit System"; 2000; 2 pages.
Sperry-Sun Multilateral Services Profile; "Sperry-Sun Latch Coupling"; 2000; 2 pages.
Sperry-Sun Multilateral Services Profile; "4501 Low-Side Perforation System"; 2000; 2 pages.
Sperry-Sun Multilateral Services Profile; "MSCS Multi-String Completion System"; 2000; 2 pages.
Sperry-Sun Multilateral Services Profile; "ITBS Isolated Tie-Back System"; 2000; 2 pages.
Sperry-Sun; "Multilateral Products, Services and Solutions"; 2000; 64 pages.
Weatherford; Fishing and Rental Tool Services; "HOMCO Internal Steel Liner Casing Patch"; 1995; 4 pages.
Search Report; Mar. 15, 2005; 1 page.

* cited by examiner 32
52
30
50
10
12
24
22
52
26
28
44
20
42
56
38
34
46
58
60
14
36
40
48
62
64
16
18
54

MONOBORE WELLBORE AND METHOD FOR COMPLETING SAME

CROSS-REFERENCE TO RELATED APPLICATIONS

This is a continuation-in-part application of application Ser. No. 10/103,381 now U.S. Pat. No. 6,749,026, entitled Downhole Tubular String Connection, filed on Mar. 21, 2002.

TECHNICAL FIELD OF THE INVENTION

This invention relates, in general, to completing a well that traverses a hydrocarbon bearing subterranean formation, and, in particular, to a monobore wellbore or multilateral monobore wellbore and method for completing the same by expanding and coupling portions of the casing downhole.

BACKGROUND OF THE INVENTION

Without limiting the scope of the present invention, its background will be described with reference to producing fluid from a subterranean formation, as an example.

After drilling each of the sections of a subterranean wellbore, individual lengths of relatively large diameter metal tubulars are typically secured together to form a casing string that is positioned within each section of the wellbore. This casing string is used to increase the integrity of the wellbore by preventing the wall of the hole from caving in. In addition, the casing string prevents movement of fluids from one formation to another formation.

Conventionally, each section of the casing string is cemented within the wellbore before the next section of the wellbore is drilled. Accordingly, each subsequent section of the wellbore must have a diameter that is less than the previous section. For example, a first section of the wellbore may receive a conductor casing string having a 20-inch diameter. The next several sections of the wellbore may receive intermediate casing strings having 16 -inch, 13⅜-inch and 9⅝-inch diameters, respectively. The final sections of the wellbore may receive production casing strings having 7-inch and 4½-inch diameters, respectively.

Each of the casing strings may be hung from a casinghead near the surface. The casinghead or spool is a heavy, flanged steel fitting connected to the first string of casing that provides a housing for slips and packing assemblies, allows suspension of intermediate and production strings of casing, and supplies the means for the annulus to be sealed off. Typically, a casing hanger provides the frictional gripping arrangement of slips and packing rings used to suspend casing from a casinghead in the well. Alternatively, some of the casing strings may be in the form of liner strings that extend from the setting depth up into another string of casing. Liners are typically suspended from the upper string by a hanger device such as a liner hanger that provides an arrangement of slips and packing rings.

It has been found, however, that each of these conventional casing techniques require multiple tubulars of decreasing diameters. Accordingly, production resources are not optimized and production is limited by the diameter of the smallest tubular. Moreover, the wellbore must be drilled to accommodate the larger tubulars and other downhole equipment such as blow-out preventers (BOPs) must be of an appropriate size to accommodate the larger tubulars.

Therefore a need has arisen for a system and method for casing a wellbore that optimizes resources while maintaining hydraulic and mechanical stability. A need has also arisen for such a system and method that minimizes the number of sizes of casing required to case the wellbore. In addition, a need has arisen for a system and method for casing a wellbore that minimizes the size requirements of equipment near the surface.

SUMMARY OF THE INVENTION

The present invention disclosed herein comprises a monobore wellbore and method for providing a monobore wellbore that are capable of optimizing available resources while maintaining hydraulic and mechanical stability. The monobore wellbore and method of the present invention require a minimum number of sizes of casing and minimize the size of equipment near the surface. The monobore wellbore of the present invention achieves these results by expanding and coupling casing strings together to create a monobore with substantially one inner diameter.

The monobore wellbore of the present invention comprises a first casing having a first inner diameter that is positioned within a wellbore. The first casing has a lap region in a downhole end thereof. A second casing is passed through the first casing and is positioned within the wellbore such that an uphole end of the second casing is positioned within the lap region of the first casing. Once expanded downhole, the second casing has an inner diameter substantially the same as the first inner diameter. The uphole end of the second casing is coupled to the lap region of the first casing. In one embodiment, the second casing is positioned within a branch wellbore of a main wellbore to form a monobore multilateral wellbore.

The coupling of the second casing to the first casing results in a mechanical connection and a hydraulic seal therebetween. In one embodiment, the uphole end of the second casing and the lap region of the first casing are physically deformed together by a crimping process. The physical deformation may be the result of a plastic deformation process. In another embodiment, the uphole end of the second casing forms a metal-to-metal seal with the lap region of the first casing. Alternatively, a sealing material such as an elastomeric sealant may be positioned between the uphole end of the second casing and the lap region of the first casing. In one embodiment, the lap region of the first casing has a diameter that is larger than the first inner diameter. This larger diameter may be formed while the first casing is downhole.

To further extend the monobore wellbore, a third casing is passed through the first and second casings and is positioned within the wellbore such that an uphole end of the third casing is positioned within a second lap region of the second casing. Once expanded downhole, the third casing has an inner diameter substantially the same as the inner diameter of the second casing. The uphole end of the third casing is coupled to the second lap region of the second casing, thereby creating a monobore wellbore.

In a further aspect, the present invention is directed to a monobore wellbore formed between two adjoining wellbores each of which extend to the surface. A first casing is positioned within a first wellbore that includes a first inner diameter and a lap region. A second casing is positioned within a second wellbore that intersects the first wellbore such that a downhole end of the second casing is positioned within the lap region of the first casing. The second casing is then expanded to an inner diameter that is substantially the same as the first inner diameter. The downhole end of the second casing is coupled to the lap region of the first casing, thereby creating a monobore wellbore of adjoining wellbores. In one embodiment, one or more of the adjoining wellbores are multilateral wellbores wherein the adjoining portions of the wellbores may be main wellbores, branch wellbores or combinations thereof.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

The present invention provides improved methods and apparatuses for creating a monobore wellbore. The methods can be performed in either vertical or horizontal wellbores. The term "vertical wellbore" is used herein to mean the portion of a wellbore in a producing zone to be completed which is substantially vertical, inclined or deviated. The term "horizontal wellbore" is used herein to mean the portion of a wellbore in a subterranean producing zone, which is substantially horizontal. Since the present invention is applicable in vertical, horizontal and inclined wellbores, the terms "upper and lower," "top and bottom," as used herein are relative terms and are intended to apply to the respective positions within a particular wellbore while the term "levels" is meant to refer to respective spaced positions along the wellbore. The term "zone" is used herein to refer to separate parts of the well designated for treatment and production and includes an entire hydrocarbon formation or even separate portions of the same formation and horizontally and vertically spaced portions of the same formation. As used herein, "down," "downward" or "downhole" refer to the direction in or along the wellbore from the wellhead toward the producing zone regardless of whether the wellbore's orientation is horizontal, toward the surface or away from the surface. Accordingly, the upper zone would be the first zone encountered by the wellbore and the lower zone would be located further along the wellbore. Tubing, tubular, casing, pipe liner and conduit are interchangeable terms used herein to refer to walled fluid conductors.

Figure 1:
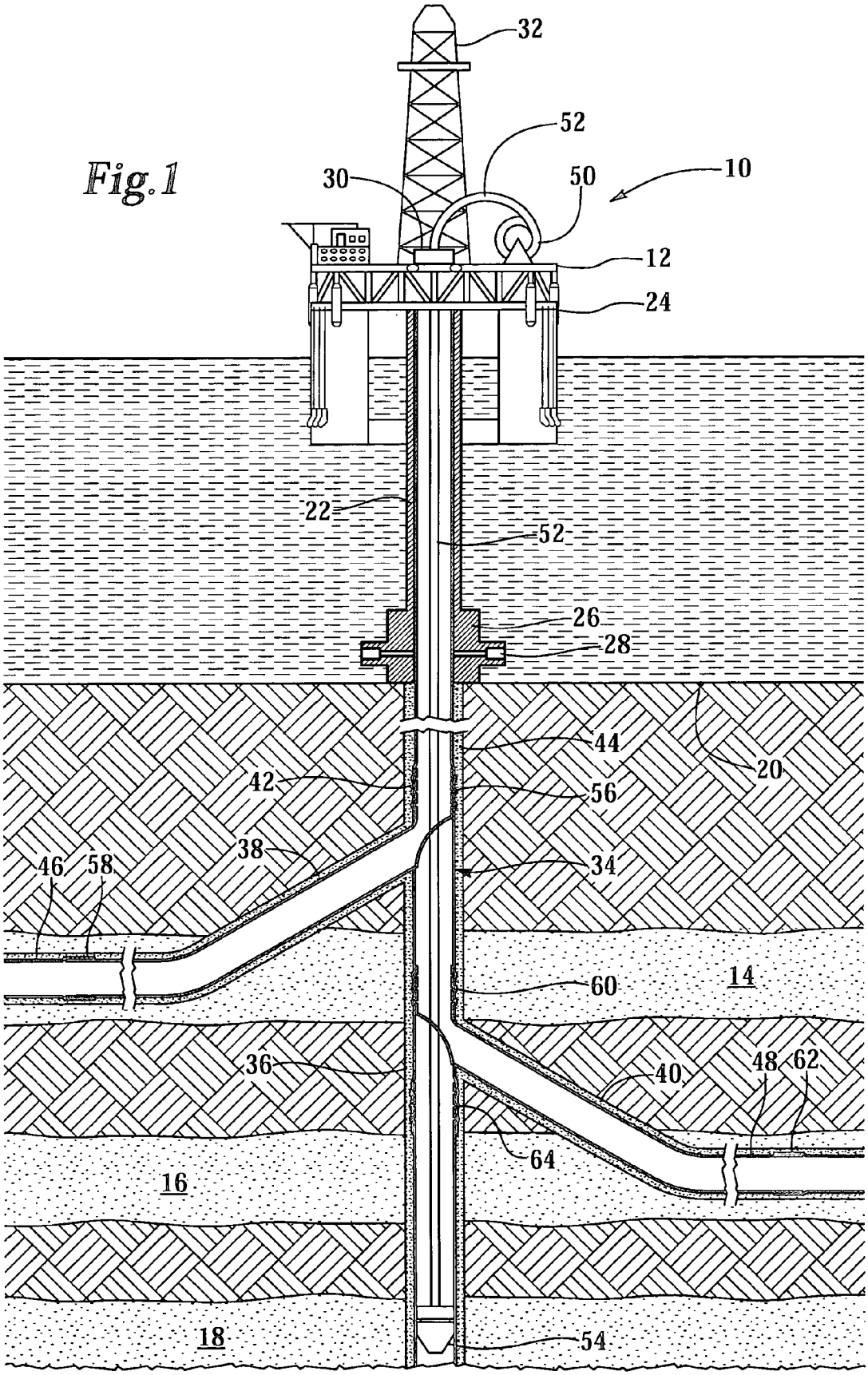
FIG. 1 is a schematic illustration of an offshore oil and gas platform installing a multilateral monobore wellbore of the present invention.

Referring initially to FIG. 1, a multilateral monobore wellbore of the present invention is being installed from an offshore oil and gas platform that is schematically illustrated and generally designated 10. A semi-submersible platform 12 is centered over submerged oil and gas formations 14, 16, 18 located below sea floor 20. A subsea conduit 22 extends from deck 24 of platform 12 to wellhead installation 26 including subsea BOPs 28. Platform 12 has a hoisting apparatus 30 and a derrick 32 for raising and lowering pipe strings.

A monobore multilateral wellbore 34 having a main wellbore 36 and branches 38, 40 extends through the various earth strata including formations 14, 16, 18. A main wellbore casing 42 is cemented within wellbore 36 by cement 44. A branch wellbore casing 46 is positioned within branch wellbore 38 and a branch wellbore casing 48 is positioned within branch wellbore 40. A reel 50 located at platform 12 raises and lowers coiled tubing 52. Coiled tubing 52 is coupled on its lower end to an expander member 54 that is positioned at the far end of main wellbore 36 after expanding the portion of the main wellbore 36 downhole of branch wellbore 40.

As explained in greater detail below, after positioning a section of casing in the wellbore such that the uphole end of the section of casing is positioned within the lap region of an existing section of casing, the new section of casing is expanded to a diameter substantially the same as the diameter of the existing section of casing by expander member 54. Additionally, a hydraulic seal and mechanical connection are created between the two casings either before or after the expansion process by expansion of the uphole end of the new section of the casing into the lap region of the existing section of casing. The system and method for creating a monobore wellbore creates regions of overlapping casings, such as overlaps 56, 58, 60, 62 and 64.

Figure 2:
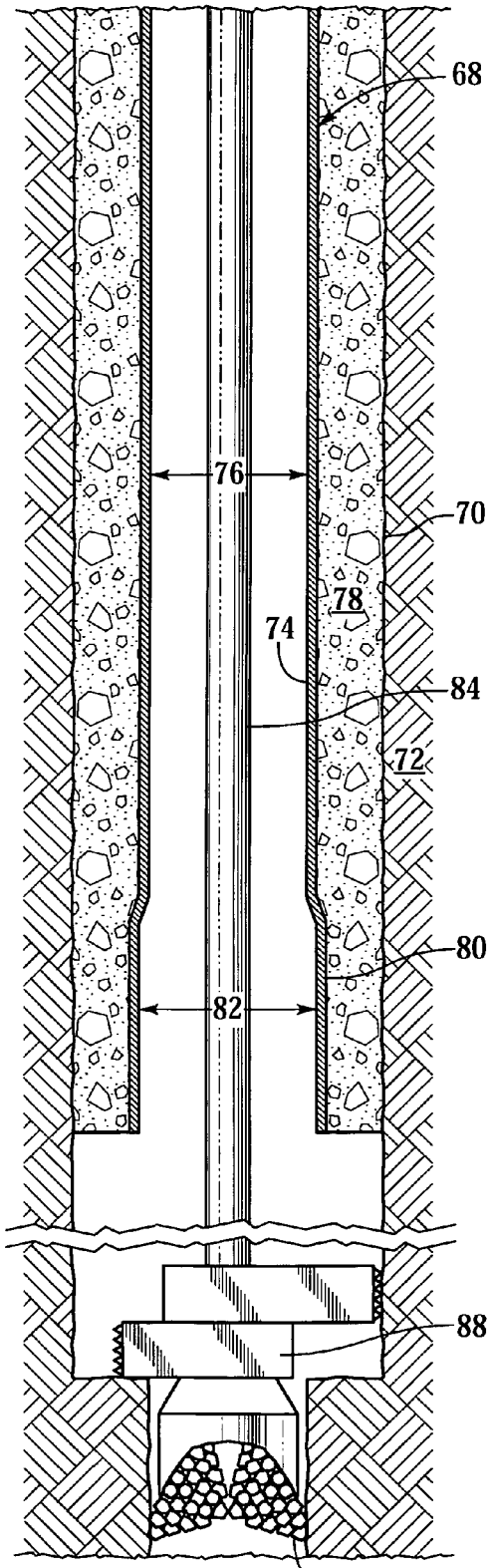
FIG. 2 is a half sectional view of a monobore wellbore according to the present invention wherein the wellbore is being extended.

Referring now to FIG. 2, therein is depicted a monobore wellbore 68 wherein a more detailed view of one method for drilling is illustrated in accordance with the teachings of the present invention. A wellbore 70 extends through various earth strata 72. A casing 74 having an inner diameter 76 is cemented within wellbore 70 by cement 78. A lap region 80 having an inner diameter 82 provides an interval in casing 74 wherein the uphole portion of an installed casing (not shown) may overlap the downhole portion of casing 74 which allows for the installation of a monobore wellbore of the present invention. Preferably, the downhole portion of casing 74 comprises an expandable material that may be expanded to form lap region 80 as described in more detail below. Alternatively, casing 74 may be prefabricated with lap region 80. As another alternative, lap region 80 may initially have the same inner diameter as the rest of casing 74 and may be expanded at the same time as the upper portion of the section of casing that is installed downhole of casing 74 and overlaps lap region 80.

After passing through casing 74, a drill string 84 transmits fluid and rotational power to a drill bit 86 to extend wellbore 70. In order to be operable, drill bit 86 must be proportioned to fit through diameter 76 of casing 74. Additionally, in order to facilitate the drilling of relatively large bores below the existing cased wellbore 70, drill bit 86 may be used in conjunction with an underreamer 88 or other device to enlarge wellbore 70 below casing 74 to a hole size larger than inner diameter 76 of casing 74. It should be apparent to one skilled in the art that although a specific drill bit assembly is illustrated and described, the drill bit may include any cutting or boring element known in the art.

Figure 3:
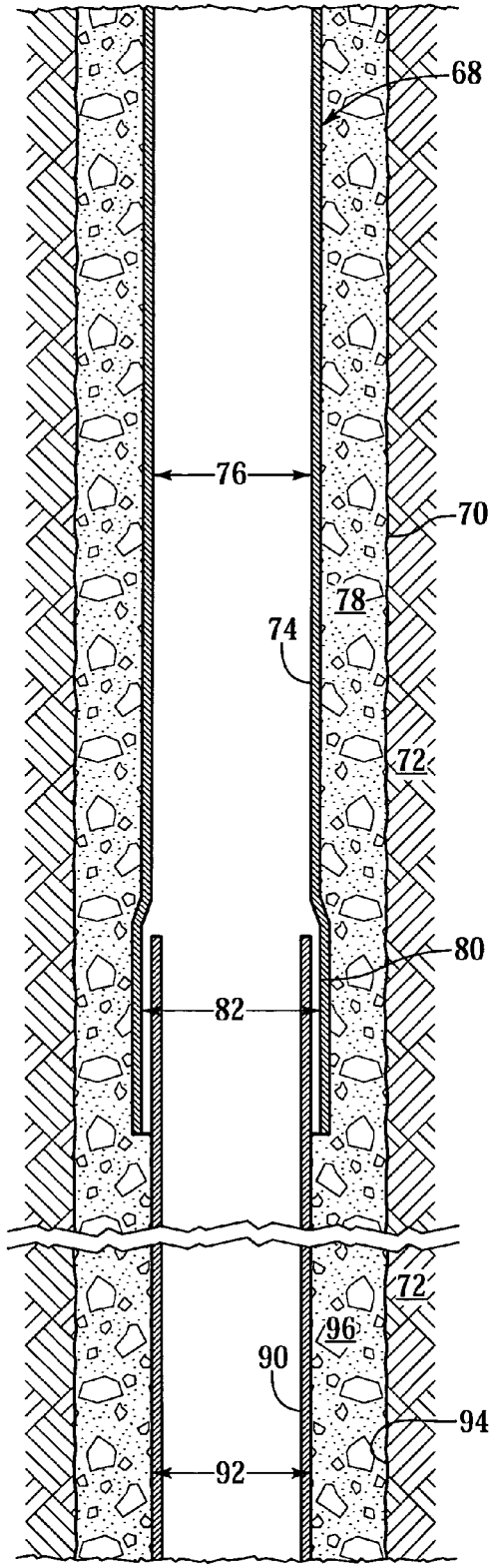
FIG. 3 is a half sectional view of a monobore wellbore according to the present invention wherein a second wellbore casing is positioned in the wellbore downhole of a first wellbore casing.

Referring now to FIG. 3, therein is depicted monobore wellbore 68 wherein casing 74 is installed in accordance with the teachings of the present invention. Following drilling to a desired depth and retrieving drill string 84, casing 90 is passed through casing 74 and is positioned within wellbore 70 such that the uphole end of casing 90 is positioned within lap region 80 of casing 74. Casing 90 has an outer diameter 92 that is smaller than inner diameter 76 of casing 74 such that casing 90 may be lowered through casing 74. As will be discussed in more detail below, casing 90 is radially expandable upon the application of a radially applied force. Casing 90 is preferably expandable and made from steel, steel alloys or other expandable materials. More specifically, casing 90 is preferably radially expandable to have an inner diameter that is substantially the same as inner diameter 76 of casing 74. In addition, the uphole end of casing 90 is coupled to lap region 80 of casing 74 by expanding the uphole end of casing 90 such that the outer diameter of casing 90 is greater than inner diameter 82 of lap region 80 of casing 74. Importantly, each lap region has a diameter large enough to accommodate the uphole portion of the next casing such that a monobore is formed. After casing 90 is positioned within wellbore 70 but prior to expansion and coupling, annulus 94 between wellbore 70 and casing 90 may be cemented by cement 96 using conventional methods such as by the deployment of a cementing tool to inject a prescribed quantity of cement 96 into annulus 94 between casing 90 and wellbore 70.

Figure 4:
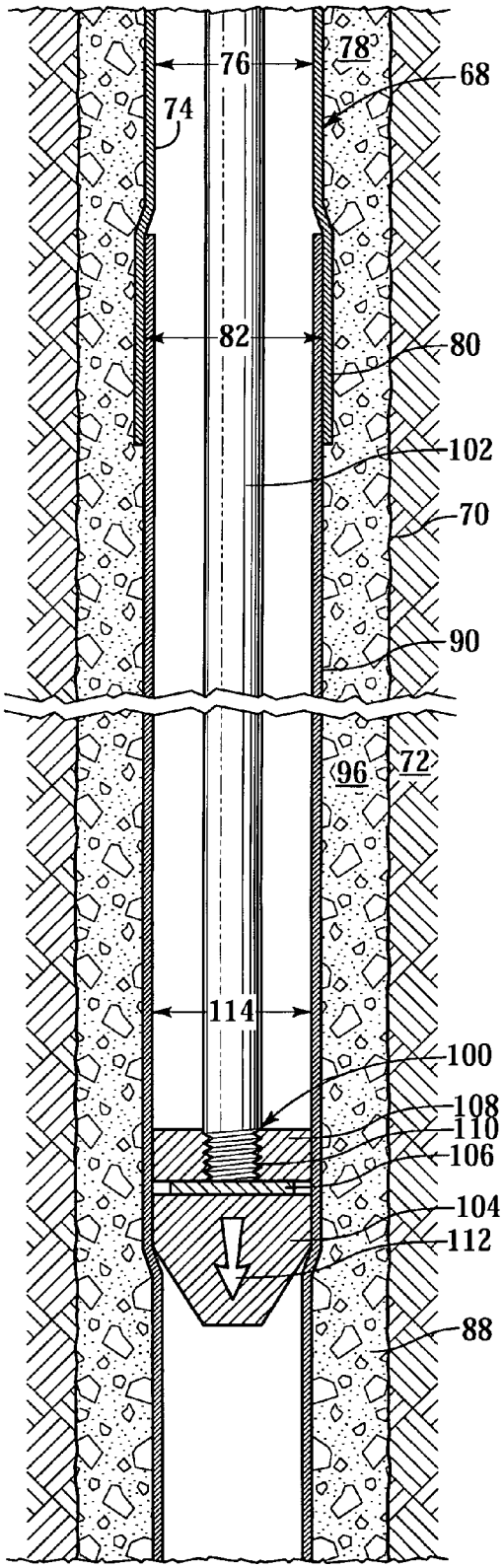
FIG. 4 is a half sectional view of a monobore wellbore according to the present invention wherein the second wellbore casing is being expanded.

Referring now to FIG. 4, therein is depicted monobore wellbore 68 wherein newly installed casing 90 is being expanded in accordance with the present invention. Following the installation of casing 90, an expander member 100 attached to coiled tubing 102 is positioned at the uphole end of casing 90. Expander member 100 includes a tapered cone section 104, a piston 106 and an anchor section 108. Anchor section 108 includes a receiver portion 110 that is coupled to the lower end of coiled tubing string 102.

In operation, a downward force is applied on expander member 100 by applying the weight of coiled tubing 102 on expander member 100. This downward force operates to stroke piston 106 to its compressed position. Once piston 106 completes its downward stroke, fluid is pumped down coiled tubing string 102 which sets anchor section 108 creating a friction grip between anchor section 108 and casing 90 which prevents upward movement of anchor section 108. As more fluid is pumped down coiled tubing string 102 into the interior of expander member 100, as indicated by arrow 112, the fluid pressure urges tapered cone section 104 downwardly such that tapered cone section 104 places a radially outward force against the wall of expandable casing 90 causing casing 90 to radially plastically deform. This process continues in step wise fashion wherein each stroke of expander member 100 expands a section of expandable casing 90. After the desired length of expandable casing 90 has been expanded, coiled tubing string 102 and expander member 100 may be retrieved to the surface. It should be understood by those skilled in the art that although the expansion of expandable casing 90 has been illustrated as progressing from an uphole position to a downhole position, the expansion could alternatively progress from a downhole location to an uphole location.

Casing 90 is expanded such that the inner diameter 114 of casing 90 is substantially the same as inner diameter 76 of casing 74, thereby providing a monobore wellbore. A wellbore of this construction employs only one size of casing and requires drilling only one hole size. Accordingly, the drilling is less complex and more economical. Similarly, the size of the downhole equipment near the surface, such as BOPs, is reduced.

Figure 5:
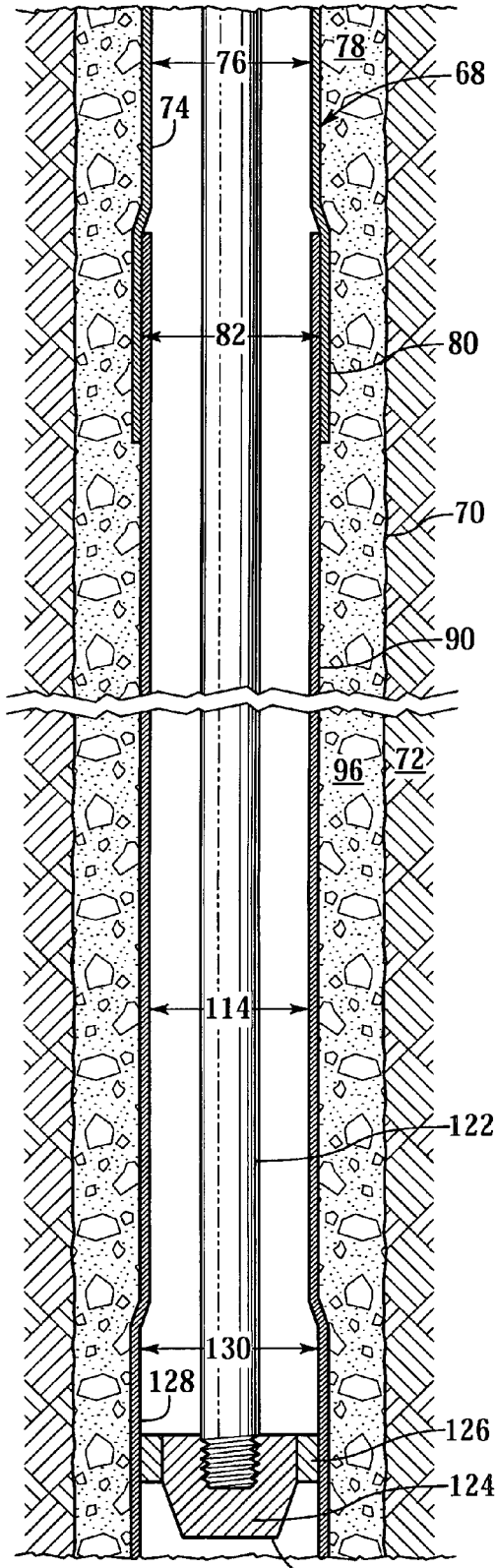
FIG. 5 is a half sectional view of a monobore wellbore according to the present invention wherein the downhole end of the second wellbore casing is undergoing a second expansion.

Referring now to FIG. 5, therein is depicted monobore wellbore 68 wherein casing 90 is undergoing a second expansion at the downhole end in accordance with the teachings of the present invention. More specifically, following the installation, cementing and first expansion of casing 90, a rolling expander member 120 coupled to a drill string 122 is positioned at the downhole end of casing 90. Rolling expander member 120 comprises a body 124 and two or more rollers 126 mounted on body 124. To expand casing 90, rollers 126 are radially extended and drill string 122 is rotated and advanced through the downhole portion of expandable casing 90. The second expansion of the downhole portion of casing 90 creates a lap region 128 having an inner diameter 130 which is substantially equal to inner diameter 82 of lap region 80. Following the creation of lap region 128, rolling expander member 120 may be removed from the wellbore to the surface. Even though specific types of expander members have been described with reference to FIGS. 4 and 5, it should be understood by to one skilled in the art that other forms of expander members may be utilized, such as expander members employing a fixed cone or expansion mandrel.

Figure 6:
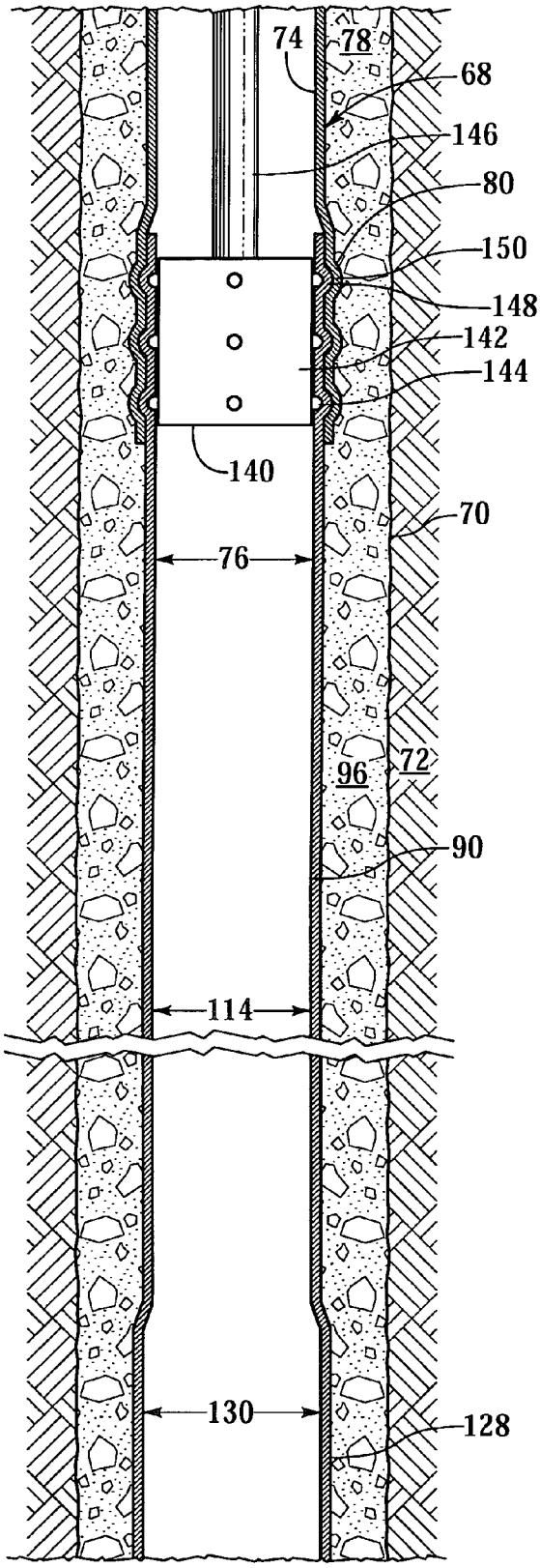
FIG. 6 is a half sectional view of a monobore wellbore according to the present invention wherein the uphole end of the second wellbore casing is coupled to a lap region of the first wellbore casing.

Referring now to FIG. 6, therein is depicted monobore wellbore 68 wherein casings 74, 90 are undergoing a coupling processes at the uphole end of casing 90 which is within lap region 80 of a casing 74 in accordance with the teachings of the present invention. In the illustrated embodiment, a crimping member 140 is positioned within the uphole end of casing 90 and lap region 80 of casing 74 to effect a hydraulic seal and mechanical connection between casings 74, 90 by creating a metal-to-metal seal therebetween.

Crimping member 140 comprises a body 142 and multiple projection members 144 mounted on body 142. A drill string 146 transmits fluid and rotational power to crimping member 140. In operation, projection members 144 are hydraulically or mechanically operated to radially expand into casing 90, thereby expanding casing 90 into casing 74. After projection members 144 expand into casing 90, crimping member 140 is rotated by drill string 146. This operation creates circumferential crimps 148, 150 in casings 74, 90, respectively which cooperate to form a hydraulic seal and a mechanical connection between casings 74, 90. The hydraulic seal prevents fluid flow between casings 74, 90. The mechanical connection provides the necessary strength and integrity to support the weight of multiple casings. It should be understood by those skilled in the art that although a particular coupling process has been illustrated, other coupling processes are within the teachings of the present invention including, but not limited to, downhole threading. Moreover, it should be understood by those skilled in the art that although a particular order of expansion, second expansion and coupling has been presented, the order of these operations is flexible. For example, the uphole portion of casing 74 could alternatively be coupled to lap region 80 of casing 74 prior to expanding casing 90 and forming lap region 128 of casing 90 with the second expansion.

The coupling and expanding of casing 90 completes the installation of this section of monobore wellbore 68. It should be understood by those skilled in the art that the monobore wellbore may be extended by drilling and installing further casing sections in accordance with the teaching of the present invention.

Figure 7:
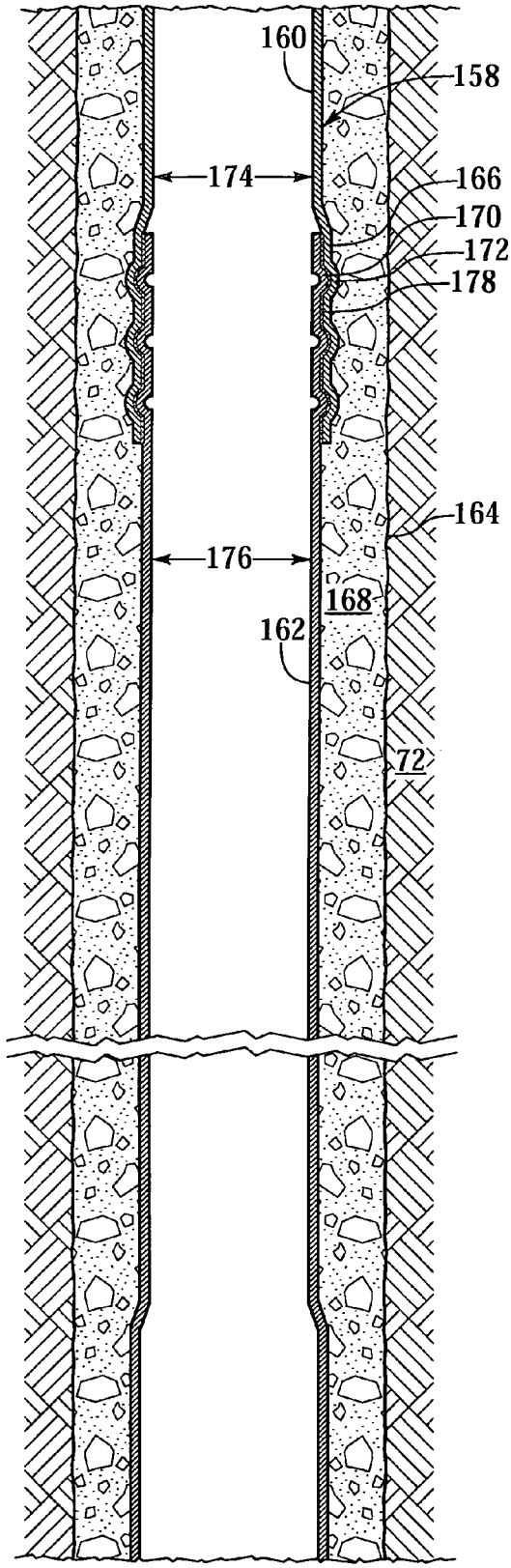
FIG. 7 is a half sectional view of a monobore wellbore according to the present invention wherein a sealing material is positioned between the overlapping regions of the first wellbore casing and the second wellbore casing.

Referring now to FIG. 7, therein is depicted monobore wellbore 158 wherein an alternate embodiment of the present invention is employed. Casings 160, 162 are disposed within wellbore 164 such that the uphole end of casing 162 is disposed within a lap region 166 of casing 160. Both casings 160, 162 are cemented within wellbore 164 by cement 168. Casings 160, 162 have undergone expansion and are coupled together in accordance with the teachings of the present invention. Accordingly, circumferential crimps 170, 172 cooperate to provide a hydraulic seal and mechanical connection between casing 160 and casing 162. Importantly, inner diameter 174 of casing 160 and inner diameter 176 of casing 162 are substantially the same to provide a monobore wellbore.

A sealing material 178 is positioned between casings 160, 162 to provide an improved hydraulic seal and mechanical connection therebetween. Preferably sealing material 176 is an elastomeric sealant characterized by a relatively low ductility and high compressive strength. It should be appreciated that depending on the characteristics of the wellbore, the characteristics of sealing material 176 may vary. For example, sealing material 176 may be characterized by relatively high ductility and low compressive strength. As another alternative, sealing material 176 may be a hardenable resin, adhesive or material operable to be sealed by chemical bonding or thermal welding, for example.

Figure 8:
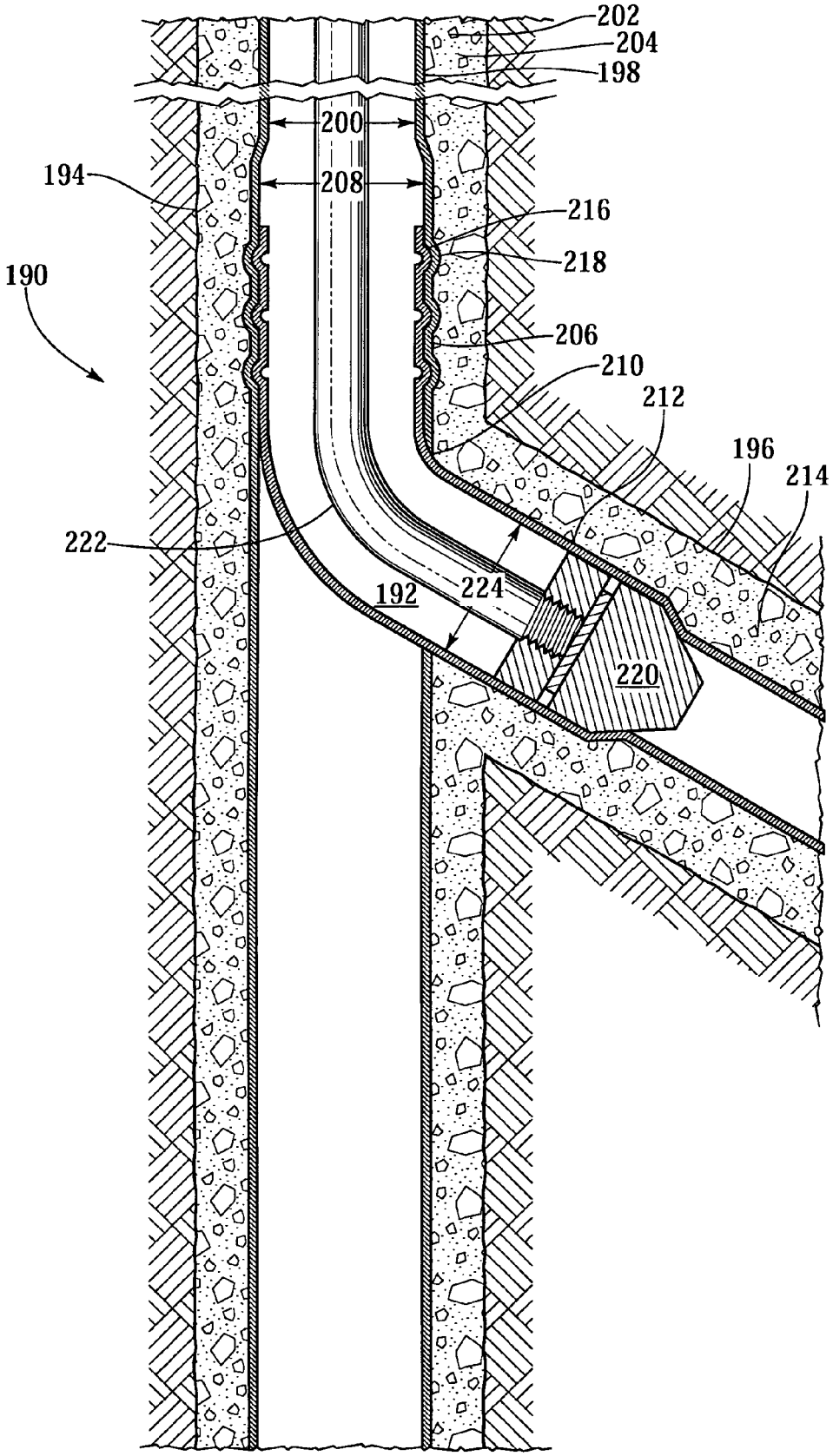
FIG. 8 is a half sectional view of a multilateral monobore wellbore according to the present invention wherein a lateral wellbore casing is being expanded.

Referring now to FIG. 8, an exemplary monobore multilateral wellbore 190 having a junction 192 between a main wellbore 194 and lateral wellbore 196 is illustrated. Main wellbore 194 is drilled using the techniques described hereinabove in FIG. 2 or other suitable drilling techniques. A main wellbore casing 198 having an inner diameter 200 is installed in main wellbore 194 and cement 202 is disposed in an annulus 204 between main wellbore 194 and main wellbore casing 198 using the techniques described hereinabove in FIG. 3 or other suitable techniques. Main wellbore casing 198 has a lap region 206 having an inner diameter 208 that is greater than inner diameter 200 so that lap region 206 can accept additional casing for a monobore wellbore.

Using conventional techniques, a whipstock is used to guide work strings supporting a variety of tools and equipment to drill and complete lateral wellbore 196. First, a window 210 is cut through main wellbore casing 198 by, for example, milling, drilling, chemical cutting or other suitable technique. Alternatively, window 210 of main wellbore casing 198 may be pre-milled and main wellbore casing 198 positioned in wellbore 194 such that window 210 has the correct orientation. Next a drill, similar to the drill employed in FIG. 2 or other suitable construction, is used to drill lateral wellbore 196 through window 210. A lateral wellbore casing 212 having an outer diameter smaller than inner diameter 200 is then passed through main wellbore casing 198 and window 210 into lateral wellbore 196. A conventional cementing tool may be used to cement an annulus 214 between lateral wellbore 196 and casing 212 with cement using a similar technique to the technique described in FIG. 3.

Lateral wellbore casing 212 is coupled to main wellbore casing 198 at lap region 206 creating a mechanical connection and hydraulic seal between crimps 216 and crimps 218. A sealing material, such as the elastomeric sealant discussed hereinabove, may be employed between lateral wellbore casing 212 and lap region 206. An expander member 220 attached to coiled tubing 222 is used to expand lateral wellbore casing 212 in branch wellbore 196. As previously described, as expander member 220 moves in a stepwise fashion, expander member 220 places a radially outward force against the wall of expandable casing 212 causing casing 212 to plastically deform. Following the expansion of casing 212, inner diameter 224 of casing 212 is substantially the same as inner diameter 200 of casing 198, thereby creating a monobore multilateral wellbore. After casing 198 is expanded, expander member 220 is removed.

Following the installation, coupling and expansion of lateral wellbore casing 212, lateral wellbore 196 may be extended and additional casing may be installed in lateral wellbore 196, by subjecting the downhole portion of lateral wellbore casing 212 to a secondary expansion to create a lap region, extending lateral wellbore 196 and installing additional casing using techniques similar to those previously discussed. The process of drilling, positioning casing, coupling, expanding and secondarily expanding to create a lap region may continue as necessary to extend lateral wellbore 196 to the desired length which creates the monobore lateral wellbore 196.

Figure 9:
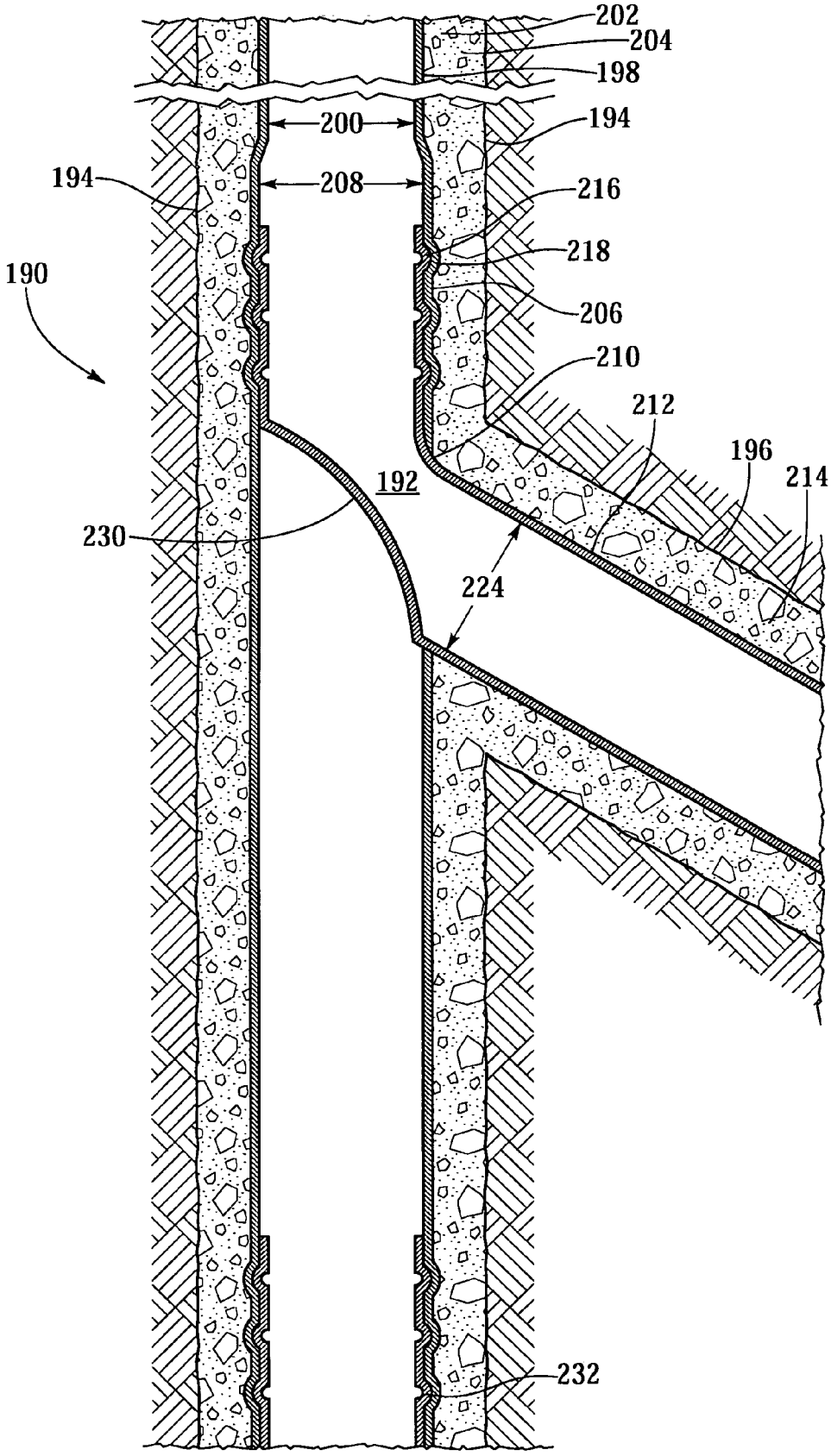
FIG. 9 is a half sectional view of a multilateral monobore wellbore according to the present invention wherein an opening has been cut through a lateral wellbore casing.

Referring now to FIG. 9, following the completion of lateral wellbore 196, a window 230 is cut through lateral wellbore casing 212 at junction 192 to reestablish communication through main wellbore 194. Window 230 allows the completion of main wellbore 194 to continue by providing a passageway for tools and casing through junction 192. For example, as illustrated, once window 230 is cut through lateral wellbore casing 212, additional sections of casing, such as casing 232 may be installed in main wellbore 194 in accordance with the present invention as main wellbore 194 is extended to the desired depth. Also, additional lateral wellbores can be drilled and completed from main wellbore 194 in accordance with the teachings of the present invention.

Figure 10:
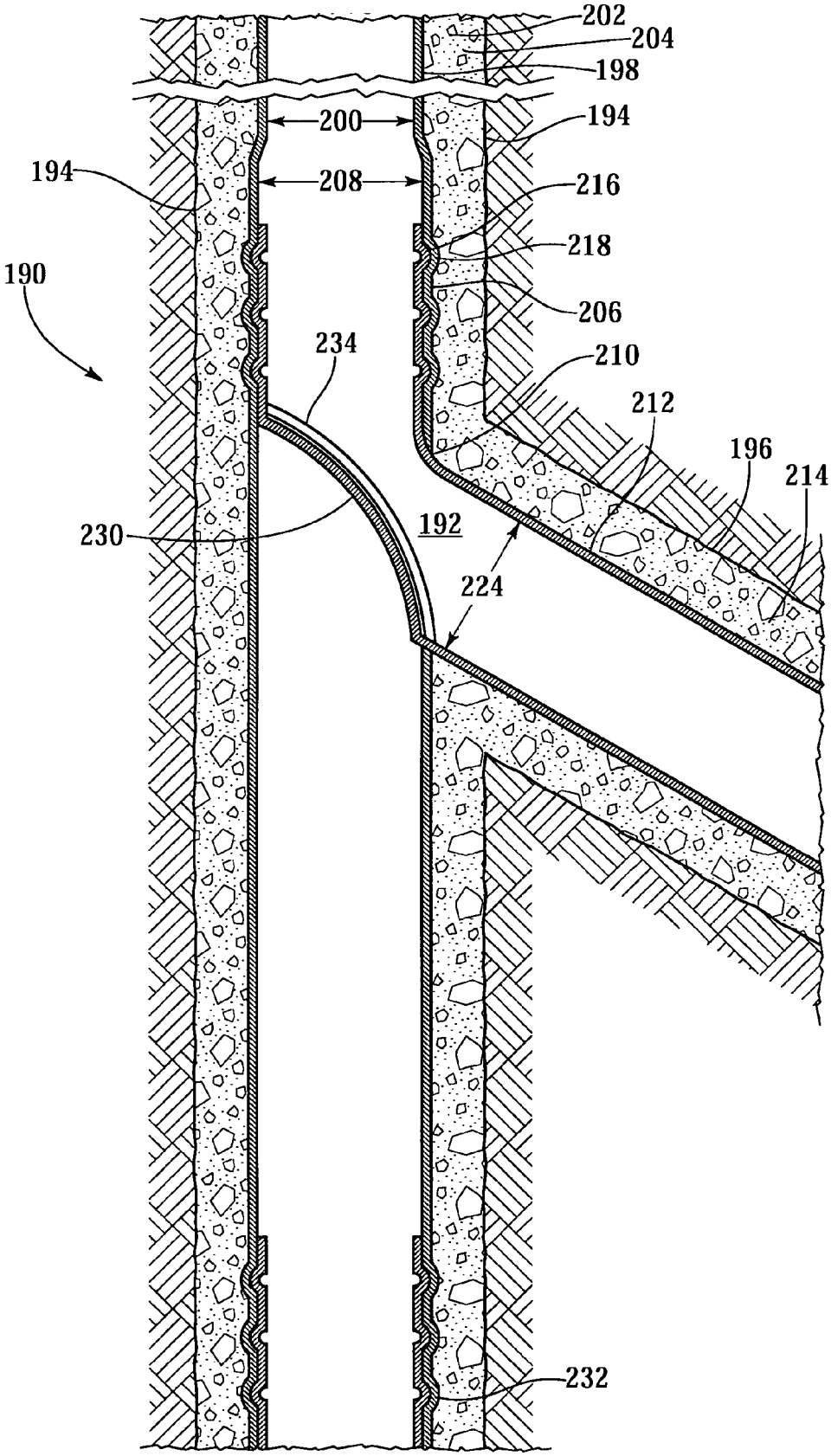
FIG. 10 is a half sectional view of a multilateral monobore wellbore according to the present invention wherein the lateral wellbore casing is coupled to the main wellbore casing around the opening.

Referring now to FIG. 10, either before or after main wellbore 194 is extended, a hydraulic seal is created between lateral wellbore casing 212 and main wellbore casing 198 to prevent fluid communication between the interior of main wellbore casing 198 and the exterior of lateral wellbore casing 212. Lateral wellbore casing 212 is coupled to main wellbore casing 198 using a crimping member similar to crimping member 164 of FIG. 6 to form a crimped seam 234. Crimped seam 234 seals lateral wellbore casing 212 and main wellbore casing 198 proximate to window 230.

Figure 11:
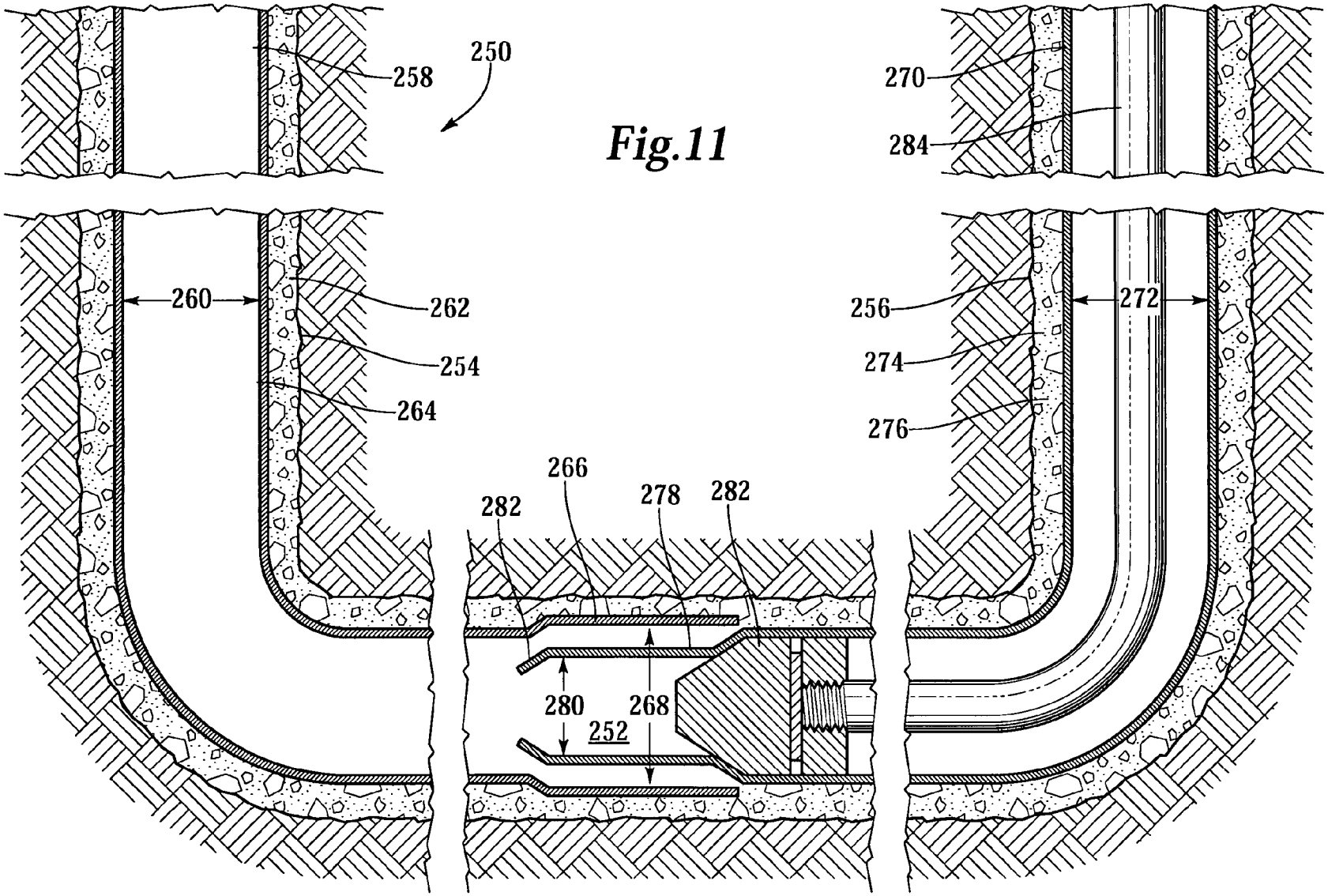
FIG. 11 is a half sectional view of a monobore wellbore formed according to the present invention between two adjoining wellbores.

Referring now to FIG. 11, an exemplary monobore wellbore 250 of adjoining wellbores is illustrated. Monobore wellbore 250 has an overlap 252 between a wellbore 254 and a wellbore 256. Wellbores 254, 256 are drilled using the techniques described hereinabove in FIG. 2 or other suitable drilling techniques. A wellbore casing 258 having an inner diameter 260 is installed in wellbore 254 and cement 262 is disposed in an annulus 264 between wellbore 254 and wellbore casing 258 using the techniques described hereinabove in FIG. 3 or other suitable techniques. Wellbore casing 258 has a lap region 266 having an inner diameter 268 that is greater than inner diameter 260 so that lap region 266 can accept casing from wellbore 256 to form a monobore wellbore.

Similarly, a wellbore casing 270 having an inner diameter 272, after expansion, is installed in wellbore 256 and cement 274 is disposed in an annulus 276 between wellbore 256 and wellbore casing 270. As illustrated, wellbore casing 270 includes an unexpanded portion 278 having an inner diameter 280 and a guide portion 282 for guiding wellbore casing 270 into lap region 266 of wellbore casing 258 to form a monbore wellbore.

As illustrated, after wellbore casing 270 is guided into wellbore casing 258 at lap region 266, expander member 282 attached to coiled tubing 284 is used to expand wellbore casing 270 into wellbore casing 258. As previously described, as expander member 282 moves in a stepwise fashion, expander member 282 places a radially outward force against the wall of expandable casing 270 causing casing 270 to plastically deform. Following the expansion of casing 270, inner diameters 272, 280 of casing 270 are substantially the same as inner diameter 260 of casing 258, thereby creating a monobore wellbore. After casing 270 is expanded, expander member 282 is removed.

Figure 12:
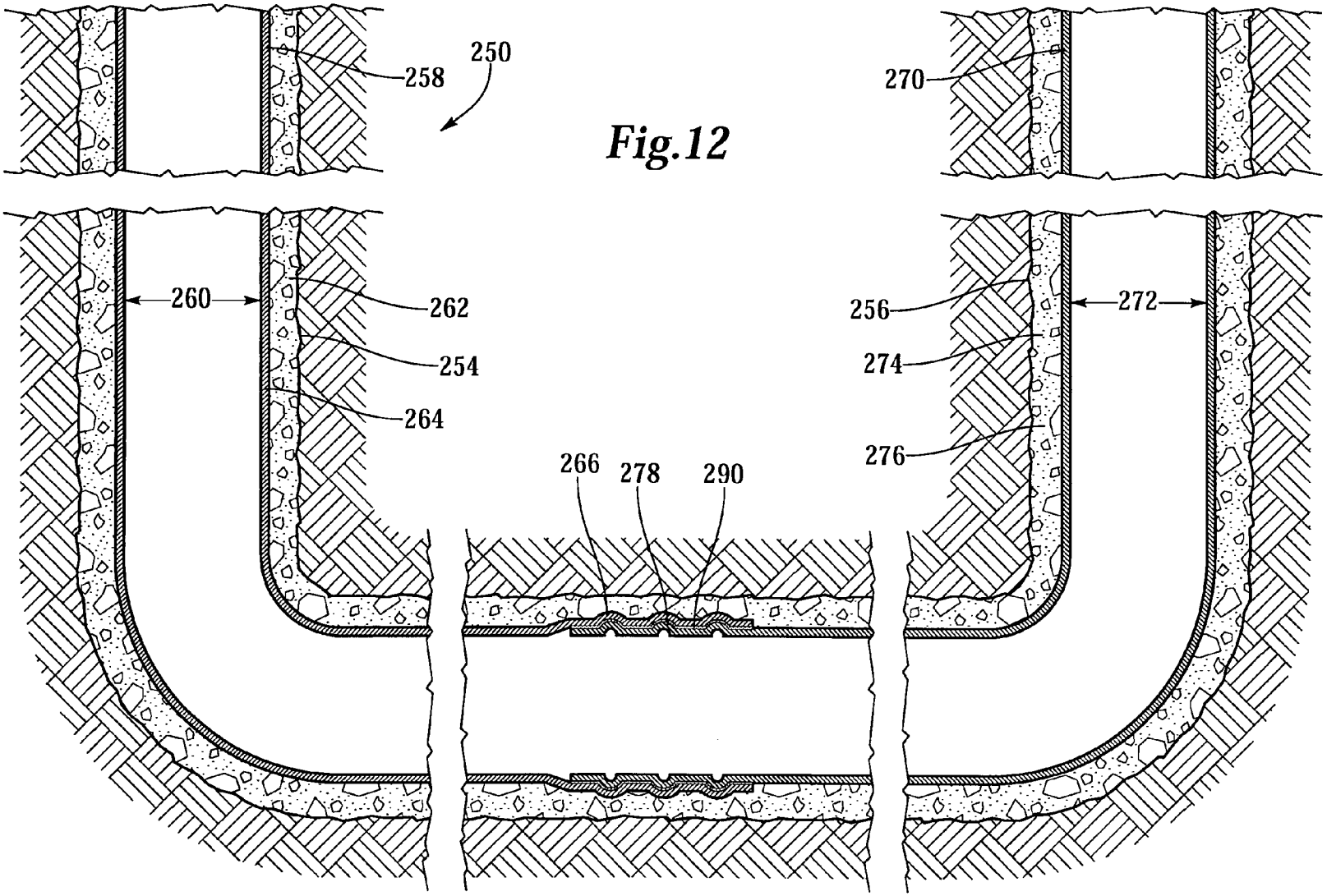
FIG. 12 is a half sectional view of a monobore wellbore according to the present invention wherein the casings within the two adjoining wellbores are coupled together.

Referring now to FIG. 12, monobore wellbore casing 258 is coupled to monobore wellbore casing 270 creating a mechanical connection and a hydraulic seal therebetween. Wellbore casing 270 is coupled to wellbore casing 258 using a crimping member similar to crimping member 164 of FIG. 6 to form connection 290, thereby creating a monobore wellbore of adjoining wellbores.

Figure 13:
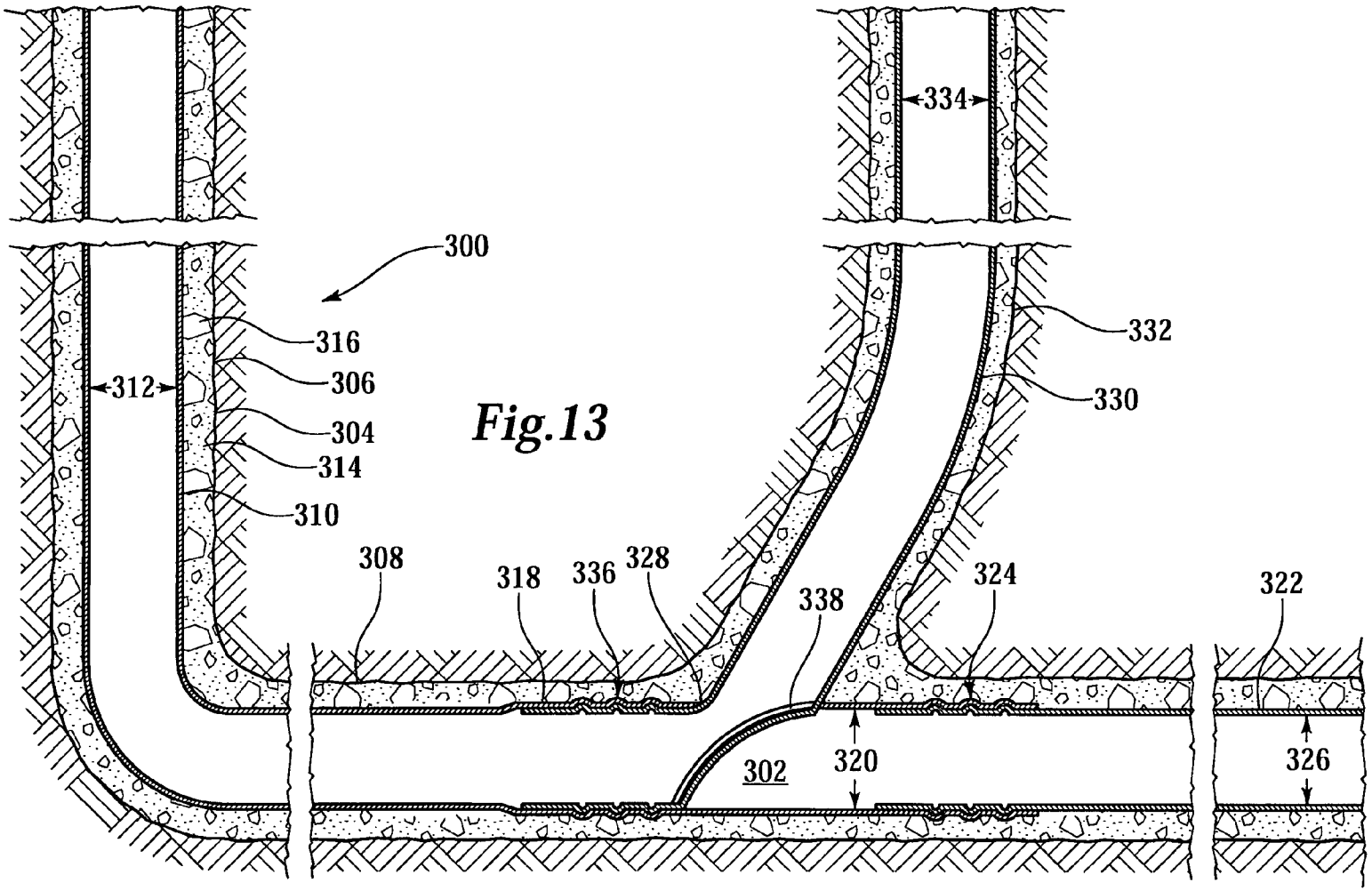
FIG. 13 is a half sectional view of a monobore wellbore according to the present invention wherein the casings of two adjoining wellbores are coupled together at a junction.

Referring now to FIG. 13, an exemplary monobore wellbore 300 of adjoining wellbores having a junction 302 is illustrated. As used herein the term adjoining wellbores refers to making a downhole connection between two or more wellbores that extend to the surface. In the illustrated embodiment, a wellbore 304 has a substantially vertical portion 306 and a substantially horizontal portion 308 that are drilled using the techniques described above or other suitable drilling techniques. A wellbore casing 310 having an inner diameter 312 is installed in wellbore 304 and cement 314 is disposed in an annulus 316 between wellbore 304 and wellbore casing 310 using the techniques described above or other suitable techniques. Wellbore casing 310 has a lap region 318 having an inner diameter 320 that is greater than inner diameter 312. Lap region 320 can accept additional casing strings therein such as wellbore casing 322 that is coupled to wellbore casing 310 using the techniques of the present invention described above at crimped connection 324 which provides a mechanical connection and a hydraulic seal. Following the expansion of casing 322, inner diameter 326 of casing 322 is substantially the same as inner diameter 312 of casing 310, thereby creating a monobore wellbore in the horizontal portion 308 of wellbore 304.

Wellbore casing 310 also has a window 328 formed through a sidewall portion thereof that receives a wellbore casing 330 from an adjacent wellbore 332 such that wellbore casing 310 of wellbore 304 adjoins wellbore casing 330 of wellbore 332. Wellbore casing 330 is cemented within wellbore 332 and is expanded using the techniques described above or other suitable techniques such that inner diameter 334 of casing 330 is substantially the same as inner diameter 312 of casing 310. Wellbore casing 330 is coupled to wellbore casing 310 at lap region 318 creating a mechanical connection and hydraulic seal at crimped connection 336 using the techniques of the present invention described above. Thereafter, crimped seam 338 is formed which seals wellbore casing 310 and wellbore casing 330 proximate to window 328 to complete junction 302, thereby creating the monobore wellbore of adjoining wellbores wherein adjoining main wellbores are coupled together.

Figure 14:
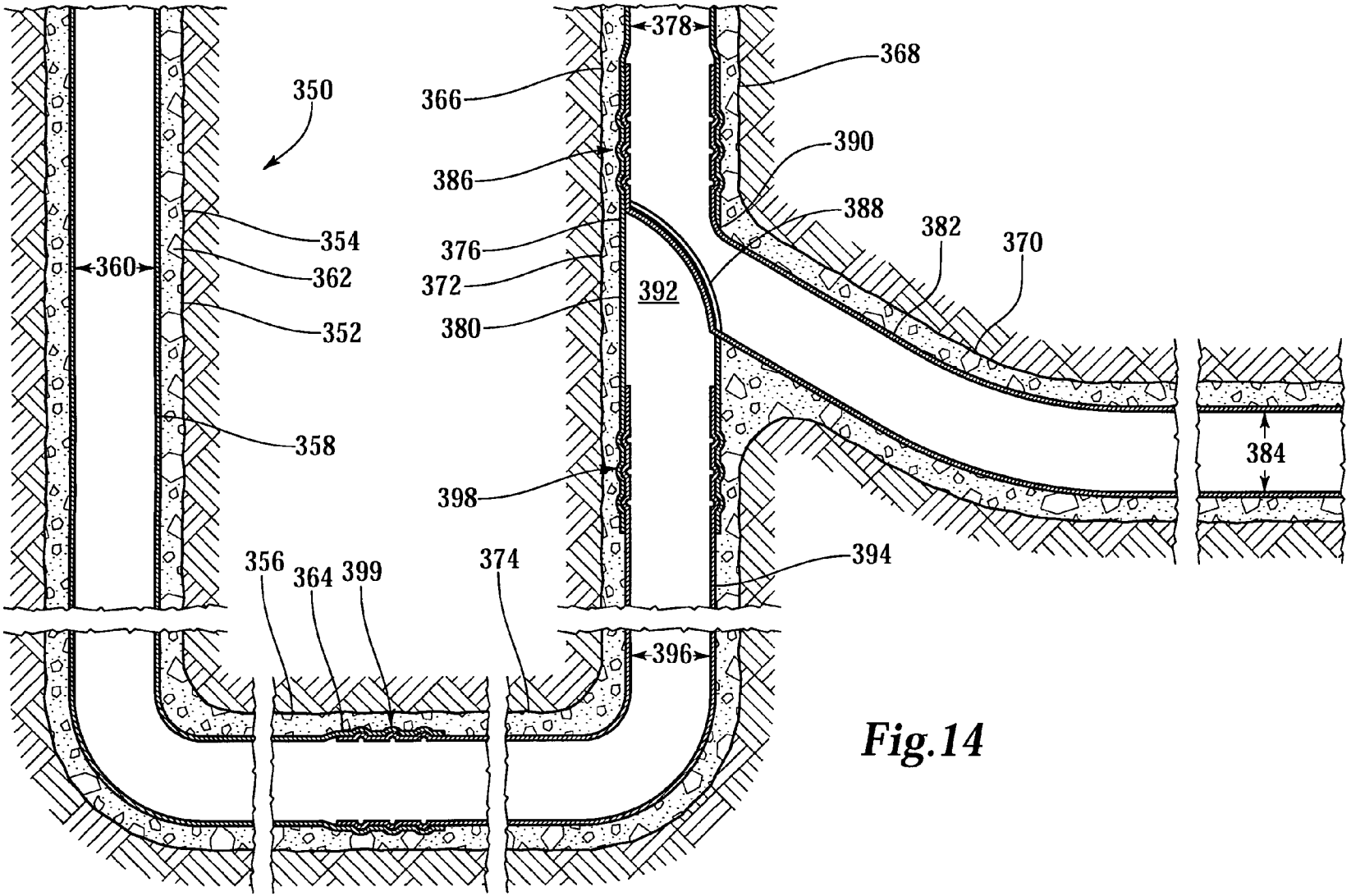
FIG. 14 is a half sectional view of a monobore wellbore according to the present invention wherein the casings of two adjoining main wellbores are coupled together.

Referring now to FIG. 14, an exemplary monobore wellbore 350 of adjoining wellbores is illustrated. In the illustrated embodiment, a wellbore 352 has a substantially vertical portion 354 and a substantially horizontal portion 356 that are drilled using the techniques described above or other suitable drilling techniques. A wellbore casing 358 having an inner diameter 360 is installed in wellbore 352 and cement 362 is disposed in the annulus therebetween using the techniques described above or other suitable techniques. Wellbore casing 358 has a lap region 364 having an inner diameter that is greater than inner diameter 360.

A wellbore 366 has a main wellbore 368 and a branch wellbore 370. Main wellbore 368 has a substantially vertical portion 372 and a substantially horizontal portion 374 that are drilled using the techniques described above or other suitable drilling techniques. A main wellbore casing 376 having an inner diameter 378 that is substantially the same as inner diameter 360 of casing 358 is installed and cemented in main wellbore 368 using the techniques described above or other suitable techniques. Main wellbore casing 376 has a lap region 380 having an inner diameter that is greater than inner diameter 378. Branch wellbore casing 382 extends into branch wellbore 370 from lap region 380. Branch wellbore casing 382 is expanded and cemented within branch wellbore 370 using the techniques described above or other suitable techniques such that inner diameter 384 of branch wellbore casing 382 is substantially the same as inner diameter 360 of casing 358. Branch wellbore casing 382 is coupled to main wellbore casing 376 at lap region 380 creating a mechanical connection and hydraulic seal at crimped connection 386 using the techniques of the present invention described above. Thereafter, crimped seam 388 is formed which seals main wellbore casing 376 and branch wellbore casing 382 proximate to window 390 to complete junction 392.

A main wellbore casing extension 394 extends from lap region 380 of main wellbore casing 376 to lap region 364 of wellbore casing 358. Following expansion, inner diameter 396 of main wellbore casing extension 394 is substantially the same as inner diameter 360 of casing 358. Main wellbore casing extension 394 is coupled to main wellbore casing 376 at lap region 380 creating a mechanical connection and hydraulic seal at crimped connection 398 using the techniques described above. Similarly, main wellbore casing extension 394 is coupled to wellbore casing 358 at lap region 364 creating a mechanical connection and hydraulic seal at crimped connection 399 using the techniques described above, thereby creating the monobore wellbore of adjoining wellbores wherein adjoining main wellbores are coupled together.

Figure 15:
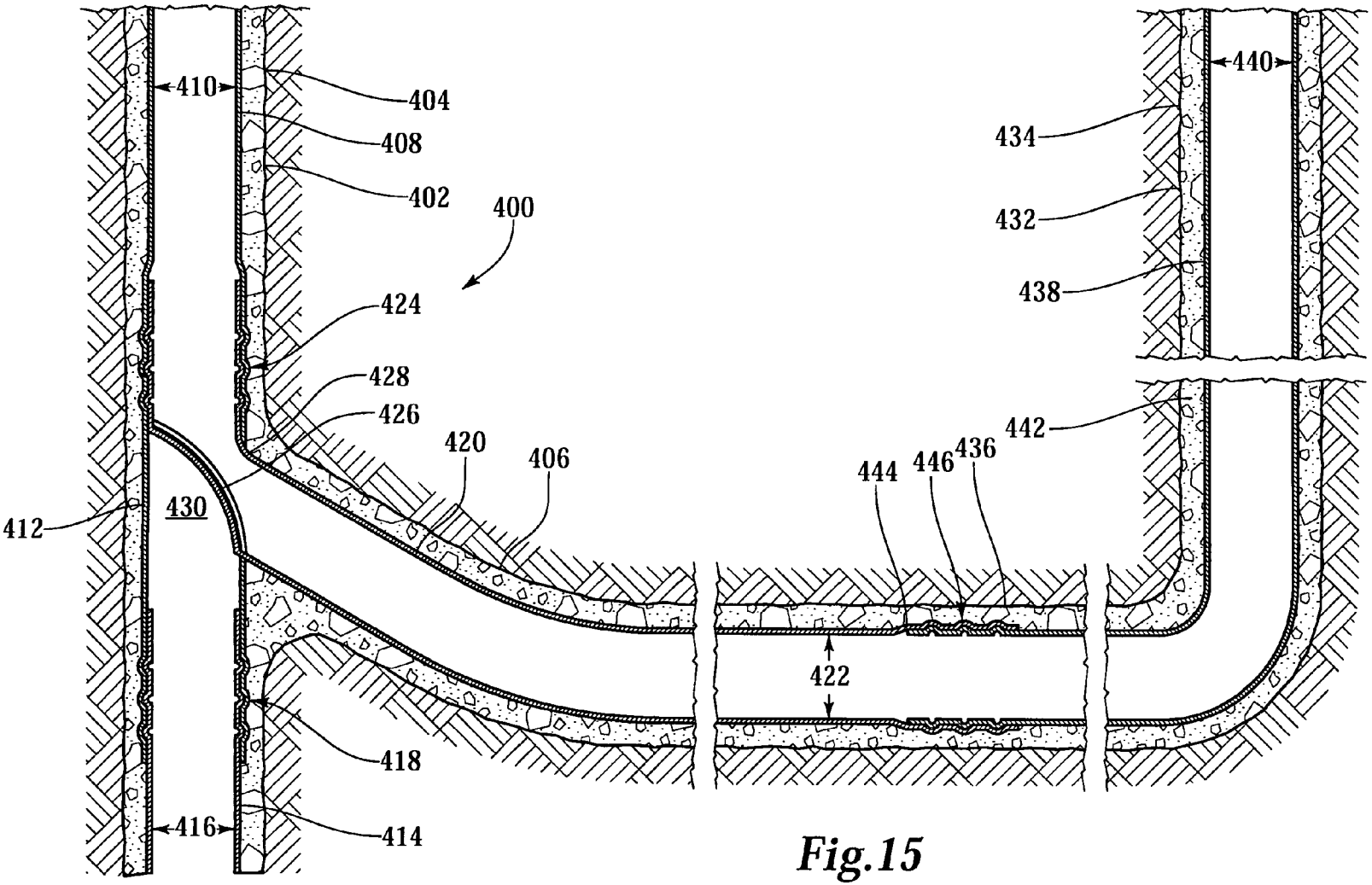
FIG. 15 is a half sectional view of a monobore wellbore according to the present invention wherein a branch wellbore casings is connected to an adjoining main wellbore casing.

Referring now to FIG. 15, another exemplary monobore wellbore 400 of adjoining wellbores is illustrated. In the illustrated embodiment, wellbore 402 has a main wellbore 404 and a branch wellbore 406 that are drilled using the techniques described above or other suitable drilling techniques. A main wellbore casing 408 having an inner diameter 410 is installed and cemented in main wellbore 404 using the techniques described above or other suitable techniques. Main wellbore casing 408 has a lap region 412 having an inner diameter that is greater than inner diameter 410. A main wellbore casing extension 414 extends from lap region 412 of main wellbore casing 408. Following expansion, inner diameter 416 of main wellbore casing extension 414 is substantially the same as inner diameter 410 of casing 408. Main wellbore casing extension 414 is coupled to main wellbore casing 408 at lap region 412 creating a mechanical connection and hydraulic seal at crimped connection 418 using the techniques of the present invention described above.

A branch wellbore casing 420 extends into branch wellbore 406 from lap region 412. Branch wellbore casing 420 is expanded and cemented within branch wellbore 406 using the techniques described above or other suitable techniques such that inner diameter 422 of branch wellbore casing 420 is substantially the same as inner diameter 410 of casing 408. Branch wellbore casing 420 is coupled to main wellbore casing 408 at lap region 412 creating a mechanical connection and hydraulic seal at crimped connection 424 using the techniques of the present invention described above. Thereafter, crimped seam 426 is formed which seals main wellbore casing 408 and branch wellbore casing 420 proximate to window 428 to complete junction 430.

An adjacent wellbore 432 has a substantially vertical portion 434 and a substantially horizontal portion 436 that are drilled using the techniques described above or other suitable drilling techniques. A wellbore casing 438 having an inner diameter 440 that is substantially the same as inner diameter 410 of casing 408 is installed in wellbore 432 and cement 442 is disposed in the annulus therebetween using the techniques described above or other suitable techniques. Branch wellbore casing 420 has a lap region 444 having an inner diameter that is greater than inner diameter 410. Wellbore casing 438 is coupled to branch wellbore casing 420 at lap region 444 creating a mechanical connection and hydraulic seal at crimped connection 446 using the techniques of the present invention described above, thereby creating the monobore wellbore of adjoining wellbores wherein a branch wellbore is coupled to an adjoining main wellbore.

Figure 16:
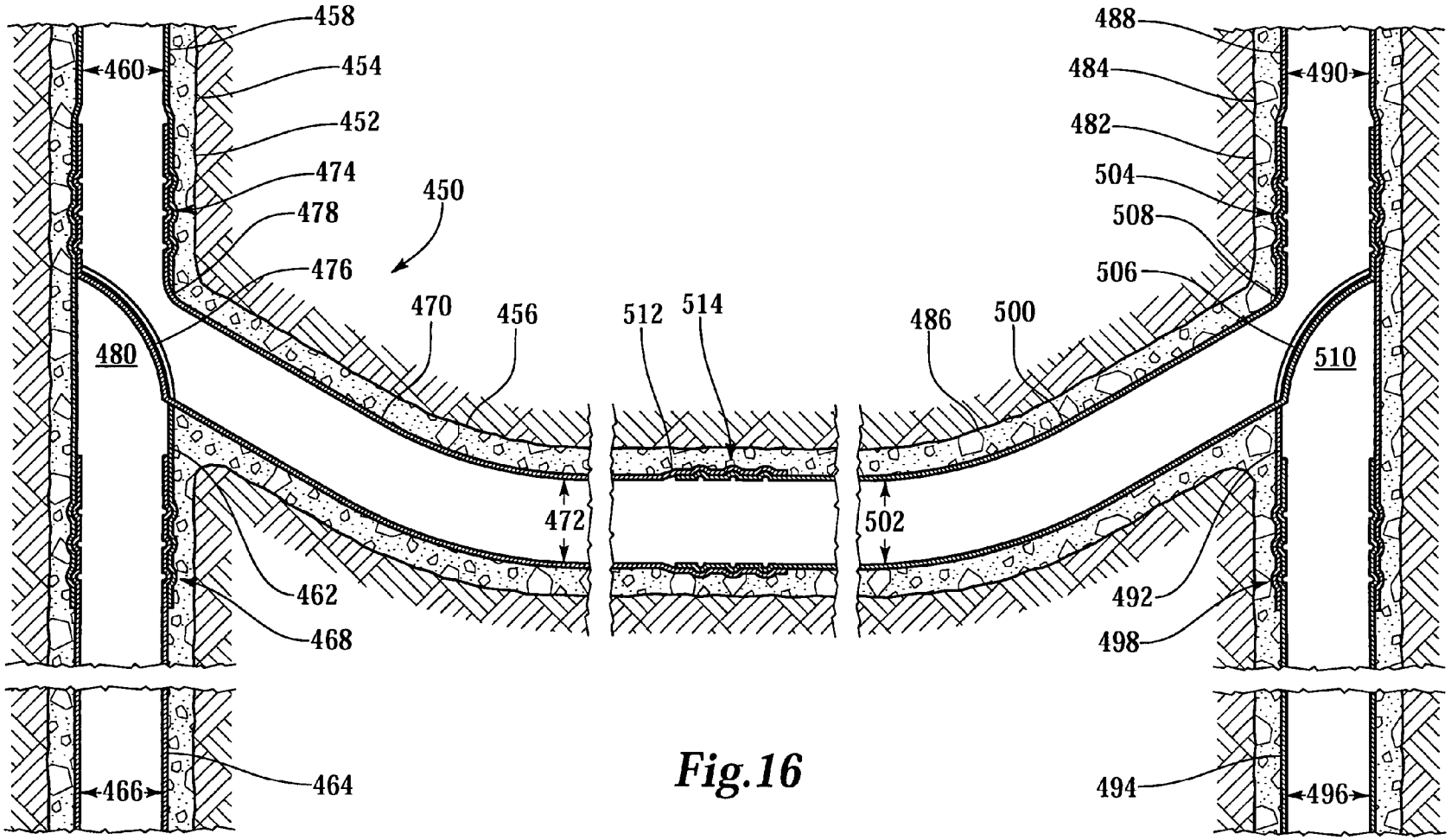
FIG. 16 is a half sectional view of a monobore wellbore according to the present invention wherein the casings of two adjoining branch wellbores are coupled together.

Referring now to FIG. 16, another exemplary monobore wellbore 450 of adjoining wellbores is illustrated. In the illustrated embodiment, wellbore 452 has a main wellbore 454 and a branch wellbore 456 that are drilled using the techniques described above or other suitable drilling techniques. A main wellbore casing 458 having an inner diameter 460 is installed and cemented in main wellbore 454 using the techniques described above or other suitable techniques. Main wellbore casing 458 has a lap region 462 having an inner diameter that is greater than inner diameter 460. A main wellbore casing extension 464 extends from lap region 462 of main wellbore casing 458. Following expansion, inner diameter 466 of main wellbore casing extension 464 is substantially the same as inner diameter 460 of casing 458. Main wellbore casing extension 464 is coupled to main wellbore casing 458 at lap region 462 creating a mechanical connection and hydraulic seal at crimped connection 468 using the techniques of the present invention described above.

A branch wellbore casing 470 extends into branch wellbore 456 from lap region 462. Branch wellbore casing 470 is expanded and cemented within branch wellbore 456 using the techniques described above or other suitable techniques such that inner diameter 472 of branch wellbore casing 470 is substantially the same as inner diameter 460 of casing 458. Branch wellbore casing 470 is coupled to main wellbore casing 458 at lap region 462 creating a mechanical connection and hydraulic seal at crimped connection 474 using the techniques of the present invention described above. Thereafter, crimped seam 476 is formed which seals main wellbore casing 458 and branch wellbore casing 470 proximate to window 478 to complete junction 480.

An adjacent wellbore 482 has a main wellbore 484 and a branch wellbore 486 that are drilled using the techniques described above or other suitable drilling techniques. A main wellbore casing 488 having an inner diameter 490 is installed and cemented in main wellbore 484 using the techniques described above or other suitable techniques. Main wellbore casing 488 has a lap region 492 having an inner diameter that is greater than inner diameter 490. A main wellbore casing extension 494 extends from lap region 492 of main wellbore casing 488. Following expansion, inner diameter 496 of main wellbore casing extension 494 is substantially the same as inner diameter 460 of casing 458. Main wellbore casing extension 494 is coupled to main wellbore casing 488 at lap region 492 creating a mechanical connection and hydraulic seal at crimped connection 498 using the techniques of the present invention described above.

A branch wellbore casing 500 extends into branch wellbore 486 from lap region 492. Branch wellbore casing 500 is expanded and cemented within branch wellbore 486 using the techniques described above or other suitable techniques such that inner diameter 502 of branch wellbore casing 500 is substantially the same as inner diameter 460 of casing 458. Branch wellbore casing 500 is coupled to main wellbore casing 488 at lap region 492 creating a mechanical connection and hydraulic seal at crimped connection 504 using the techniques of the present invention described above. Thereafter, crimped seam 506 is formed which seals main wellbore casing 488 and branch wellbore casing 500 proximate to window 508 to complete junction 510. Branch wellbore casing 470 has a lap region 512 having an inner diameter that is greater than inner diameter 460. Branch wellbore casing 500 is coupled to branch wellbore casing 470 at lap region 512 creating a mechanical connection and hydraulic seal at crimped connection 514 using the techniques of the present invention described above, thereby creating the monobore wellbore of adjoining wellbores wherein adjoining branch wellbores are coupled together.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A monobore system of adjoining wellbores comprising:

a first casing positioned within a first wellbore extending from the surface, the first casing having a first inner diameter and a lap region; and a second casing positioned within a second wellbore extending from the surface that adjoins the first wellbore such that a downhole end of the second casing is positioned within the lap region of the first casing, the second casing having a second inner diameter that is substantially the same as the first inner diameter, the downhole end of the second casing being coupled to the lap region of the first casing when the first casing is positioned within the first wellbore and the second casing is positioned within the second wellbore.

2. The monobore system as recited in claim 1 wherein the downhole end of the second casing forms a mechanical connection and a hydraulic seal with the lap region of the first casing.

3. The monobore system as recited in claim 1 wherein the downhole end of the second casing and lap region of the first casing are physically deformed.

4. The monobore system as recited in claim 1 wherein the downhole end of the second casing and lap region of the first casing are physically deformed by a plastic deformation process.

5. The monobore system as recited in claim 1 wherein the second casing intersects the first casing through a window in the first casing forming a junction therewith.

6. The monobore system as recited in claim 1 wherein the first casing comprises a main wellbore casing of a multilateral wellbore.

7. The monobore system as recited in claim 1 wherein the first casing comprises a branch wellbore casing of a multilateral wellbore.

8. The monobore system as recited in claim 1 wherein the second casing comprises a main wellbore casing of a multilateral wellbore.

9. The monobore system as recited in claim 1 wherein the second casing comprises a branch wellbore casing of a multilateral wellbore.

10. The monobore system as recited in claim 1 wherein the first and second casings comprise branch wellbore casings of multilateral wellbores.

11. The monobore system as recited in claim 1 wherein the first and second casings comprise main wellbore casings of multilateral wellbores.

12. The monobore system as recited in claim 1 wherein the first casing is a main wellbore casing and the second casing comprises a branch wellbore casing of a multilateral wellbore.

13. The monobore system as recited in claim 1 wherein the first casing comprises a branch wellbore casing and the second casing is a main wellbore casing of a multilateral wellbore.

14. A method of forming a connection between adjoining wellbores comprising the steps of:

installing a first casing within a first wellbore extending from the surface, the first casing having a first inner diameter and a lap region;

installing a second casing within a second wellbore extending from the surface that adjoins the first wellbore such that a downhole end of the second casing is positioned within the lap region of the first casing, the second casing having a second inner diameter that is substantially the same as the first inner diameter; and coupling the downhole end of the second casing to the lap region of the first casing downhole.

15. The method as recited in claim 14 wherein the coupling step further comprises forming a mechanical connection and a hydraulic seal between the second casing and the lap region of the first casing.

16. The method as recited in claim 14 wherein the coupling step further comprises physically deforming the downhole end of the second casing and lap region of the first casing.

17. The method as recited in claim 14 wherein the coupling step further comprises plastically deforming the downhole end of the second casing and lap region of the first casing.

18. The method as recited in claim 14 wherein the installing a second casing step further comprises intersecting the second casing with the first casing through a window in the first casing forming a junction therewith.

19. The method as recited in claim 14 wherein the installing a first casing step further comprises installing a main wellbore casing in a multilateral wellbore.

20. The method as recited in claim 14 wherein the installing a first casing step further comprises installing a branch wellbore casing in a multilateral wellbore.

21. The method as recited in claim 14 wherein the installing a second casing step further comprises installing a main wellbore casing of a multilateral wellbore.

22. The method as recited in claim 14 wherein the installing a second casing step further comprises installing a branch wellbore casing in a multilateral wellbore.

* * * * *